United States Patent [19]

Roberts et al.

[11] Patent Number: 4,823,525

[45] Date of Patent: Apr. 25, 1989

[54] SKYLIGHT STRUCTURE

[75] Inventors: Joseph W. Roberts; John C. Roberts, both of Orlando; Gordon MacLeod, Apopka, all of Fla.

[73] Assignee: Tub-Master Corporation, Orlando, Fla.

[21] Appl. No.: 243,916

[22] Filed: Sep. 13, 1988

[51] Int. Cl.[4] ..... E04B 7/18

[52] U.S. Cl. ..... 52/200

[58] Field of Search ..... 52/200, 58, 72

[56] References Cited

U.S. PATENT DOCUMENTS

| | | | |
|---|---|---|---|
| 2,643,156 | 11/1954 | Wasserman | 52/200 |
| 2,790,400 | 4/1957 | Wasserman | 52/200 |
| 3,034,260 | 5/1962 | Wasserman | 52/200 |
| 3,127,699 | 4/1964 | Wasserman | 52/200 |
| 3,350,823 | 11/1967 | Murray | 52/200 |
| 3,417,522 | 12/1968 | Kiekhaefer | 52/200 |
| 3,417,527 | 12/1968 | Kiekaafer | 52/200 |
| 4,514,944 | 5/1985 | Doell | 52/200 |

OTHER PUBLICATIONS

Progressive Architecture, Mar. 1955, p. 163.

*Primary Examiner*—John E. Murtagh

*Attorney, Agent, or Firm*—Duckworth, Allen, Dyer & Doppelt

[57] ABSTRACT

A skylight structure offering superior water intrusion resistance has a glass plate superposed in spaced relationship above a plastic dome member having an integral inverted U-shaped flange. A cap marginally framing the glass and plastic members has spaced downwardly depending flanges with an inner shorter flange abutting the outer surfaces of the plastic flange and an outer longer flange spaced from and shielding the outer surfaces of the plastic flange. The outside lower end of the U-shaped flange is cured outwardly.

12 Claims, 1 Drawing Sheet

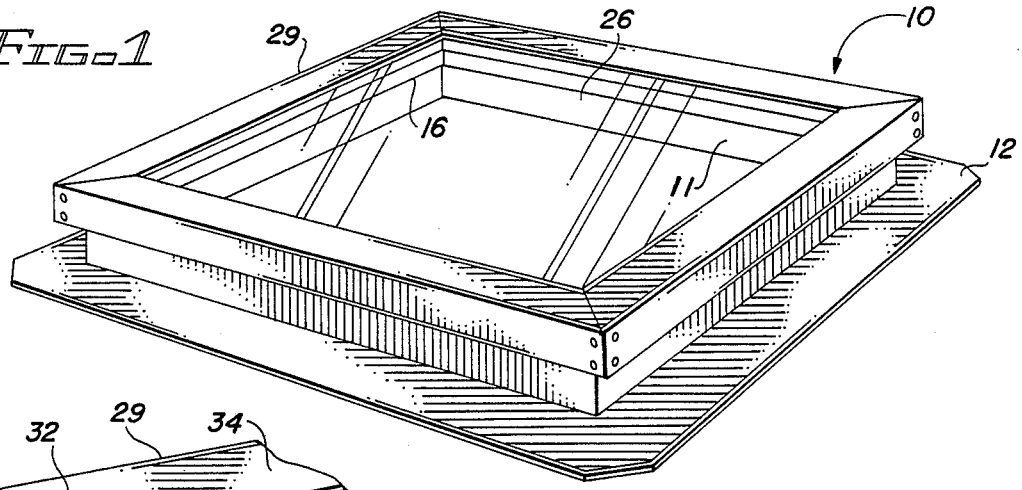
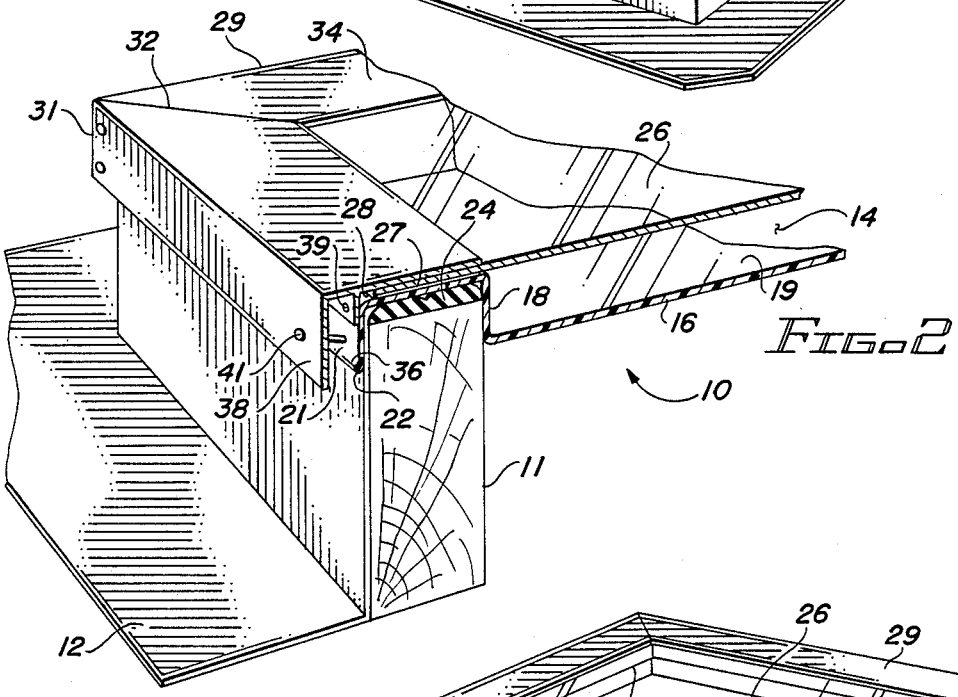
FIG. 2
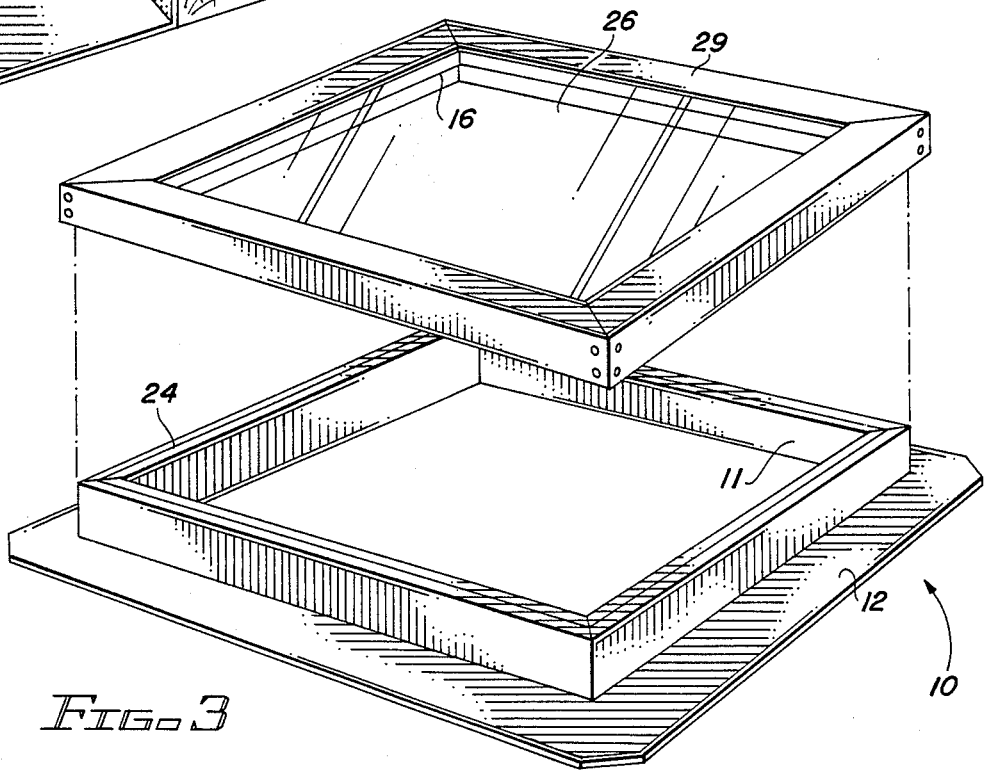
FIG. 3

SKYLIGHT STRUCTURE

This invention relates to skylight structure for use in connection with a curb extending upwardly around the edges of a roof opening, and the like.

BACKGROUND OF THE INVENTION

Various forms of lenses for skylights are known in the prior art. Examples are set forth in U.S. Pat. Nos. 2,693,156; 2,790,400; 3,034,260; 3,127,699; 3,417,527; 4,514,944; and Canadian Pat. No. 689,527. Those references show plastic domes for covering a roof opening, mounted either directly to the roof decking itself or mounted thereto by means of some type of intermediate framing member, such as an upwardly extending marginal curb. Wasserman U.S. Pat. No. 3,127,699 and Kiekhaefer U.S. Pat. No. 3,417,527, for example, teach the use of a double plastic dome having an external or upper member overlying an internal or lower member in peripherally sealed relationship to provide an insulating dead air space therebetween. This is a desirable feature, but the use of plastic as an outer dome material leads to undesirable thermal deformation and/or discoloration.

It is important with such skylight structures to ensure that moisture is kept out of the living space below the skylight structure and also, for double domed structures, to keep moisture out of the dead air space. Various flanging and sealing arrangements exist. There is, however, a continuing problem of providing good sealing against water and moisture intrusion. Where flanges are brought into close contact with adjacent structural members, paths for capillary action movement of water are introduced.

The use of glass lens members for skylight structures is likewise known. These are not readily shapable and are especially undesirable above living spaces because of hazards caused by breakage. They do, nevertheless, offer superiority over plastics in avoiding deformation and other deterioration when acted on by direct hot sunlight.

SUMMARY OF THE INVENTION

The invention provides an improved skylight structure which combines the benefits of both glass and plastic lenses in a configuration that offers superior sealing and protection against water intrusion.

In one aspect of the invention a double domed structure is provided which utilizes an external glass member overlying an internal plastic member. The glass member offers good resistance to sagging and other adverse effects of sunlight and the underlying plastic member acts as a safety barrier to protect the living space below from glass breakage.

In another aspect of the invention, glass and plastic members of a double domed skylight structure are framed by means of a framing member taking the form of a marginal cap having first and second peripheral, downwardly extending flanges spaced outwardly relative to each other to provide an annular gap that impedes the inward flow of water by capillary action, adhesion, or the like.

A preferred embodiment of the invention, discussed in greater detail below, comprises a skylight structure for mounting on the curb of a roof cutout, which has a planar sheet of glass superposed over a plastic safety shield and held to the same by means of a metal cap.

The plastic shield is centrally recessed and has a peripheral inverted U-shaped flange which comes up and over the mounting curb and includes a downturned outer portion. The glass rests on tape positioned on the upper surface of the flange. The metal cap provides a marginal fitting above the flange on the opposite side of the glass with depending peripheral flanges, one shorter flange abutting against the outer surface of the downturned part of the plastic flange and another longer flange spaced out from the plastic flange.

BRIEF DESCRIPTION OF THE DRAWINGS

An embodiment of the invention has been chosen for purposes of illustration and description, and is shown in the accompanying drawings, wherein:

FIG. 1 is an overall perspective view of an embodiment of skylight structure in accordance with the principles of the invention, shown seated on underlying roof opening curb structure;

FIG. 2 is a fragmentary, sectional view of the structure of FIG. 1; and

FIG. 3 is a view, as in FIG. 1, with the lens structure raised up from the curb structure to illustrate the mounting relationship.

Throughout the drawings, like elements are referred to by like numerals.

DESCRIPTION OF THE PREFERRED EMBODIMENTS

The invention is described in terms of a rectangular opening version of a skylight structure 10 used with a fixed curb mounted on the decking of a roof. The example of FIGS. 1-3 is merely illustrative and it will, of course, be appreciated that the same principles may be applied to different opening configurations, as well as to curbs in the form of hatches, etc.

A roof of a building has decking in the form of plywood panels or other material (not shown) into which an opening has been cut in well-known manner. The edges of the opening are surrounded by insulated cedar or other wooden curb elements 11 (see FIG. 2) which extend upwardly from the roof deck. Painted galvanized angled flashing 12, or other similar roof flashing, extends upwardly from the roof deck to a point adjacent the top of the curb elements 11, to provide protection from the weather to the junctions of the elements 11 with the decking.

The skylight structure 10 of the present invention is applied to the curbed opening to provide daylight transmission, while preventing rainwater and moisture from humidity from reaching the living space below. The shown structure 10 includes a captured dead air space 14 for insulation. The space 14 may be filled with air, nitrogen or some other inert light transmitting insulating material.

The structure 10 (see FIG. 2) comprises a lower or internal rectangular plastic member 16 adapted to cover the roof opening on the living space side. The plastic member 16 is formed from a single molded or otherwise shaped sheet of plastic with an integral peripheral flange 18 having an inverted U-shape, as shown. The flange 18 starts from a flat horizontally running, central portion 19 of the member 16 proceeds upwardly in a substantially vertical manner, then outwardly in a horizontal manner, and then downwardly in a vertical manner along a downturned portion 21 which has a lowermost end 22. The flange 18 is configured so that the end 22 is spaced from the planar portion 19 by the width of the curb 11, but is otherwise approximately located at the same level above the living space below. The inverted U-shape of the flange 18 serves to seat the skylight lens structure 10 on top of the curb 11, as shown. A neoprene rubber or similar sealing strip 24 is positioned between the top of the curb 11 and the inside of the horizontal surface of the flange 18 to act as a protective barrier.

An external or upper member 26 in the form of a rectangular glass plate is superposed to overlie the plastic member 16, with the central portion 19 of the plastic member 16 being spaced in recessed manner from the plane of the glass plate 26. The glass 26 is positioned with marginal portions of the underside of the plate 26 resting on the upper surface of the horizontally running portion of the plastic flange 18, as shown. The intervening air space 14 is sealed by means of a tape or gasket sealing element 27 between the confronting portions of the flange 18 and the glass plate 26. As shown, the sealing element 27 is in the form of a continuous strip running perimetally between the periphery of the glass 26 and the upper surface of the inverted U-shaped flange 18. The outermost edge of the glass plate 26 is located inwardly of the outermost edge of the horizontal portion of the flange 18. A bead of silicon elastomer, glue 28 or similar bonding sealant is flowed between the perimetal edge of the glass plate 26 and the flange 18.

The plastic member 16 and glass member 26 may be formed from suitable materials with possible choices for the inner dome 16 being LEXAN ® plastic and for the outer plate 26 being ⅛-inch tempered glass. The materials are selected as clear, tinted, diffused or otherwise, according to individual preferences.

An annular framing member in the form of a bronze anodized aluminum cap 29 is provided to border the upper surface of the glass member 26. The purpose of the member 29 is to provide edge protection from the weather for the structure and, in the configuration shown, it is particularly useful to prevent water from being drawn up by capillary action into the avenues of contact between the curb 11 and the dual lens structure 16, 26.

The preferred cap structure takes the form of metal angle elements 31 joined at mitred corners 32 to frame the skylight structure 10. An upper horizontal portion 34 of each angle element 31 runs outward from a marginal portion in the plane of the glass member 26 to a point spaced beyond the outside edge of the glass. The angle elements 31 are provided with first and second downwardly extending flanges 36 and 38. The first flange 36 runs generally vertically adjacent the outer surface of the downturned portion 21 of the plastic flange 18. The second flange 38 is spaced outwardly a distance from the first flange and runs substantially parallel thereto.

The inner flange 36 serves to cover the juncture between the glass plate 26 and the flange 18 of the plastic member 16. Fasteners in the form of pop rivets 39 periodically spaced around the periphery of the top of the outer portion 21 of the flange 18 serve to join the cap 29 to the plastic and glass members 16 and 26. As shown, the rivets 39 are fastened by driving them at an angle from the inside of the flange 18 during assembly, and prior to mounting on the curb elements 11.

The outer flange 38 is longer than the inner flange 36 an extends downwardly generally for the full length of the downturned portion 21 of the plastic member 16. The skylight structure 10 is mounted to the curb elements 11 by driving fasteners 41 through the flange 36 and the downturned portion 21 of the plastic member 16, into the curb elements 11. In the depicted embodiment, there is no direct fixed connection between the glass plate 26 and the cap 29.

The described structure 20 provides superior protection against the intrusion of water between abutting surfaces of the curb 11 and the plastic flange 18. The spacing between the lower ends of the outer flange 38 of the flange 29 and the end 22 of the portion 21 of the flange 18 acts as a barrier to capillary action or adhesion by water that drains down the exposed surfaces of the caps. The lower end 22 of the downturned portion 21 of the plastic member 16 is moreover preferably rounded outwardly to provide additional protection to prevent water from coming up underneath the plastic member 16.

It is, thus, evident from the described embodiment that the invention provides improved skylight structure with dead air space insulation and improved water intrusion resistance.

Those skilled in the art will appreciate that the embodiment of the invention shown in the accompanying drawings is just one example of how the invention can be implemented, and that various substitutions and modifications may be made thereto without departing from the spirit and scope of the invention as defined by the claims below.

What is claimed is:

1. A skylight structure for use in connection with a roof opening having a curb extending around the edges of the opening, comprising:

an internal plastic member adapted to cover said opening, said plastic member having an integral peripheral flange adapted and configured to seat on said curb, said flange including a downturned portion for location outwardly of said curb, said downturned portion having a lowermost end;

an external glass member overlying said internal member in spaced relationship at opposing central portions of said members and abutting said internal member marginally at confronting portions of said integral flange internally of said downturned portion;

means providing a seal between said confronting portions for establishing an insulating dead air space between said central portions;

a framing member in the form of a cap bordering an upper surface of said external member, said cap having a first flange extending downwardly outwardly beyond a perimetal edge of said external member and adjacent an outer surface of said downturned portion, and a second downwardly extending flange spaced outwardly from said first flange and establishing a sheltered gap between said second flange and said downturned portion for impeding the inward flow of water from exposed surfaces of said skylight structure; and means securing said cap to said internal and external members.

2. A skylight structure as in claim 1, wherein the downward extent of said first flange is shorter than the downward extent of said second flange.

3. A skylight as in claim 2, wherein the downward extent of said second flange is generally equal to the downward extent of said downturned portion.

4. A skylight as in claim 3, wherein said lowermost end is curved outwardly.

5. A skylight as in claim 1, wherein said integral flange is an inverted U-shaped flange.

6. A skylight as in claim 5, wherein said glass member is a plate glass member, and said central portion of said plastic member is a planar section parallel to said glass plate member.

7. A skylight as in claim 6, wherein said sealing means comprises a continuous sealing strip running perimetally of said confronting portions of said members.

8. A skylight as in claim 7, wherein the outward extent of said glass plate is less than the outward extent of said plastic member; and wherein said sealing means comprises a bead of sealing material run along an outer edge of said glass plate.

9. A skylight structure as in claim 1, further comprising:

gasket means adapted and configured to provide a weather resistant protective barrier between curb seating surfaces of said internal member and a curb.

10. A skylight structure for use in connection with a roof opening having a curb extending upwardly around the edges of the opening, comprising:

internal plastic member having a planar central portion adapted to cover said opening and having an integral inverted U-shaped peripheral flange adapted and configured to seat on over said curb, an outer downturned portion of said flange being dimensioned for location outwardly of said curb, said downturned portion having a lowermost end;

an external glass plate member overlying said internal member in spaced, parallel opposing relationship to said central portion of said internal member, and abutting said internal member marginally at confronting portions of said integral flange internally of said downturned portion;

means providing a seal between said confronting portions for establishing an insulating dead air space between said central portions;

a framing member in the form of a cap bordering an upper surface of said external member, said cap having a first flange extending downwardly outwardly beyond a perimetal edge of said external member and adjacent an outer surface of said downturned portion, and a second downwardly extending flange spaced outwardly from said first flange and establishing a sheltered gap between said second flange and said downturned portion for impeding the inward flow of water from exposed surfaces of said skylight structure; the downward extension of said second flange being generally the same as the downward extension of said downturned portion but greater than the downward extension of said first flange; and means securing said cap to said internal and external members.

11. A skylight structure as in claim 10, wherein said lowermost end of said downturned portion is curved outwardly.

12. A skylight structure comprising:

a roof deck having an opening therein;

a curb extending upwardly around the edges of said opening;

flashing extending upwardly from said roof deck to a point adjacent a top portion of said curb;

an internal plastic member having a planar central portion adapted to cover said opening and having an integral inverted U-shaped peripheral flange adapted and configured to seat on over said curb, an outer downturned portion of said flange being dimensioned for location outwardly of said curb, said downturned portion having a lowermost end;

an external glass plate member overlying said internal member in spaced, parallel opposing relationship to said central portion of said internal member, and abutting said internal member marginally at confronting portions of said integral flange internally of said downturned portion;

means providing a seal between said confronting portions for establishing an insulating dead air space between said central portions;

a framing member in the form of a cap bordering an upper surface of said external member, said cap having a first flange extending downwardly outwardly beyond a perimetal edge of said external member and adjacent an outer surface of said downturned portion, and a second downwardly extending flange spaced outwardly from said first flange and establishing a sheltered gap between said second flange and said downturned portion for impeding the inward flow of water from exposed surfaces of said skylight structure; the downward extension of said second flange being generally the same as the downward extension of said downturned portion but greater than the downward extension of said first flange;

means securing said cap to said internal and external members; and gasket means adapted and configured to provide a weather resistant protective barrier between curb seating surfaces of said internal member and said curb.

* * * * *